US009737151B1

(12) United States Patent
Orlando

(10) Patent No.: US 9,737,151 B1
(45) Date of Patent: Aug. 22, 2017

(54) SLEEP BARRIER SYSTEM

(71) Applicant: Gary Orlando, Jackson, NJ (US)

(72) Inventor: Gary Orlando, Jackson, NJ (US)

( * ) Notice: Subject to any disclaimer, the term of this patent is extended or adjusted under 35 U.S.C. 154(b) by 0 days.

(21) Appl. No.: 15/260,553

(22) Filed: Sep. 9, 2016

(51) Int. Cl.
*A47C 21/00* (2006.01)
*A47C 31/00* (2006.01)

(52) U.S. Cl.
CPC ..... *A47C 21/00* (2013.01); *A47C 31/00* (2013.01)

(58) Field of Classification Search
CPC ..... A47C 21/00; A47C 21/02; A47C 21/022; A47C 21/026; A47C 21/08; A47C 31/00; A47G 5/00
USPC ..... 5/513, 658, 663, 503.1, 946, 424, 425, 5/655, 657, 420, 417; 52/144, 145; 160/135, 351
See application file for complete search history.

(56) References Cited

U.S. PATENT DOCUMENTS

| | | | | |
|---|---|---|---|---|
| 754,353 | A | 3/1904 | Smith | |
| 925,916 | A | 6/1909 | Jones | |
| 1,092,298 | A | 4/1914 | Schwarz | |
| 1,094,679 | A | 4/1914 | Roberti | |
| 2,471,977 | A | 5/1949 | Power | |
| 2,510,656 | A * | 6/1950 | Randel | A47C 21/00 5/513 |
| 2,563,570 | A | 8/1951 | Williams | |
| 3,927,481 | A * | 12/1975 | Safranek | A47G 5/00 160/130 |
| 4,016,919 | A * | 4/1977 | Zmijewski | A47C 21/00 160/130 |
| 4,480,715 | A * | 11/1984 | Brooks | E04B 1/8227 181/287 |
| 5,190,350 | A * | 3/1993 | Hwang | A47C 1/143 297/226 |
| 5,265,292 | A * | 11/1993 | Underell | A47C 4/52 297/380 |
| 5,384,923 | A * | 1/1995 | Hwang | A47C 1/143 297/380 |
| D360,775 | S | 8/1995 | Karkoska et al. | |
| 7,690,158 | B2 * | 4/2010 | Kelly | E04B 2/7405 181/291 |
| 2005/0076585 | A1 * | 4/2005 | Kelly | E04B 2/7429 52/144 |
| 2008/0066233 | A1 | 3/2008 | Russell | |

FOREIGN PATENT DOCUMENTS

| | | |
|---|---|---|
| WO | WO9117066 | 11/1991 |

* cited by examiner

*Primary Examiner* — Robert G Santos

(57) ABSTRACT

A sleep barrier system for separating users during sleep includes a bed that has a top side, a headboard and a pair of pillows. A barrier is selectively positioned on the bed. The barrier extends between the pair of pillows. Moreover, the barrier sequesters a pair of users thereby inhibiting the users from physically disturbing each other during sleep.

7 Claims, 4 Drawing Sheets

SLEEP BARRIER SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to barrier devices and more particularly pertains to a new barrier device for separating users during sleep.

BRIEF SUMMARY OF THE INVENTION

An embodiment of the disclosure meets the needs presented above by generally comprising a bed that has a top side, a headboard and a pair of pillows. A barrier is selectively positioned on the bed. The barrier extends between the pair of pillows. Moreover, the barrier sequesters a pair of users thereby inhibiting the users from physically disturbing each other during sleep.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
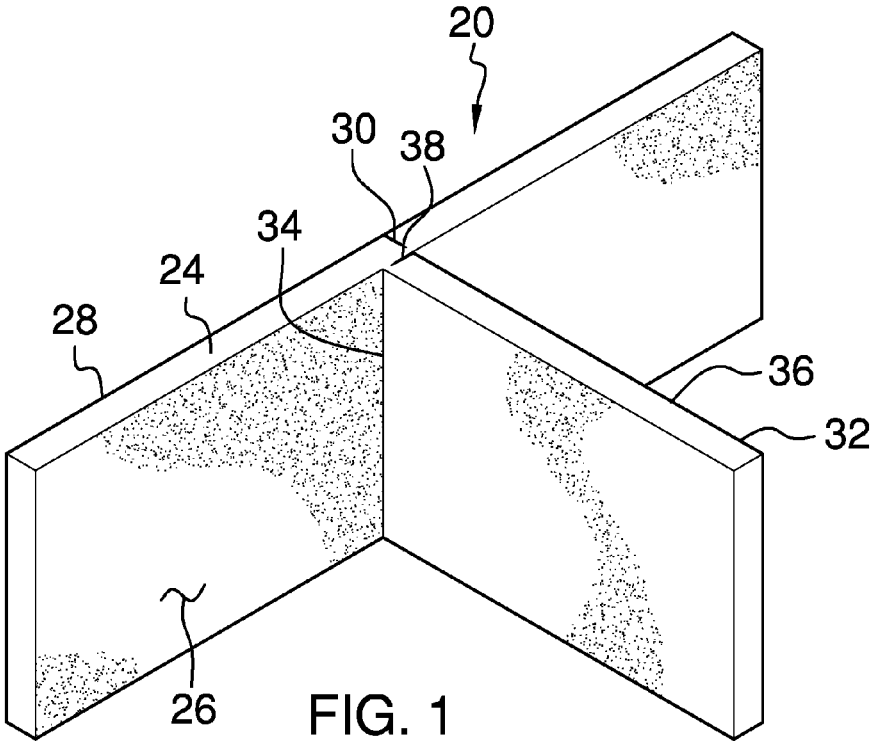
FIG. 1 is a perspective view of a barrier of a sleep barrier system according to an embodiment of the disclosure.
Figure 2:
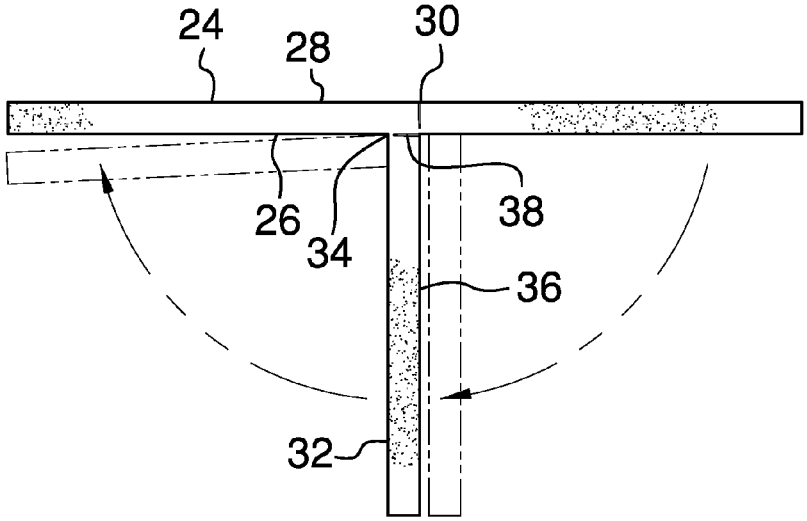
FIG. 2 is a top view of a barrier of an embodiment of the disclosure.
Figure 3:
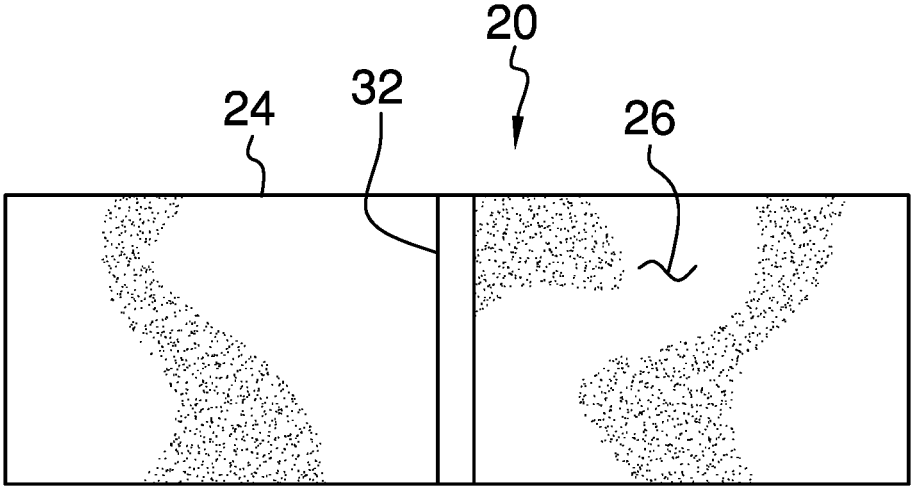
FIG. 3 is a front view of a barrier of an embodiment of the disclosure.
Figure 4:
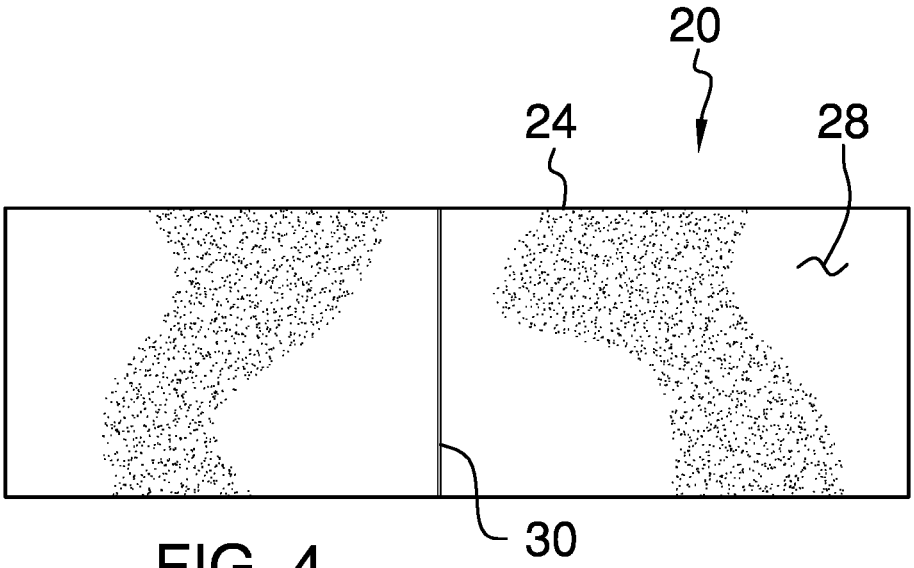
FIG. 4 is a back view of a barrier of an embodiment of the disclosure.
Figure 5:
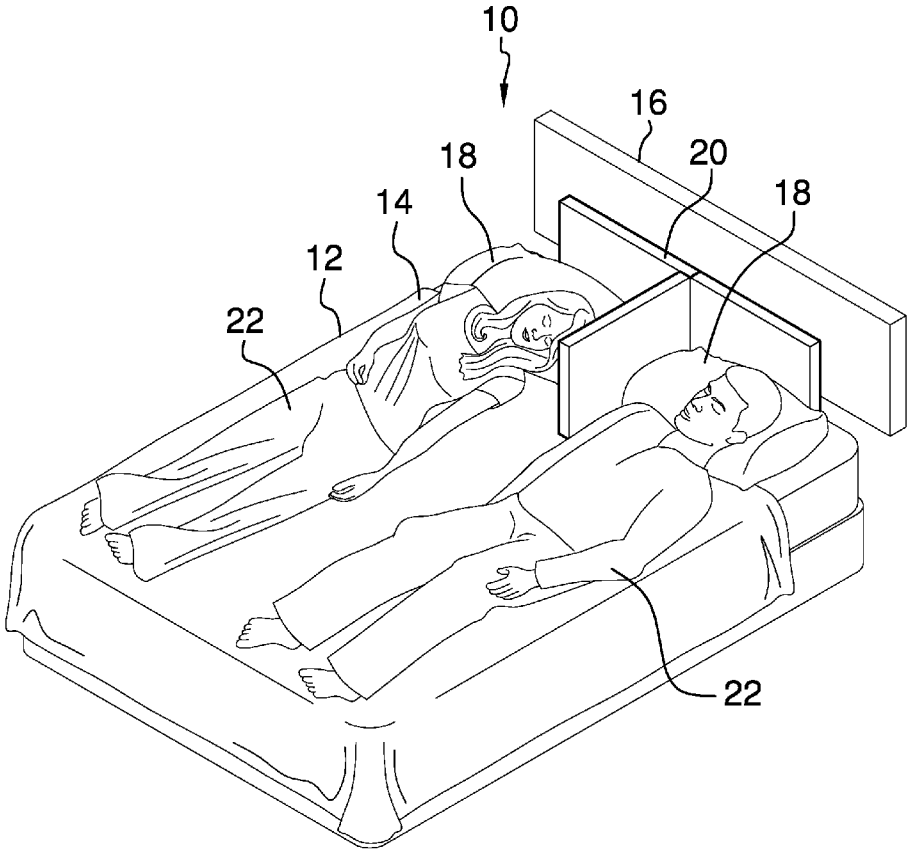
FIG. 5 is a perspective in-use view of an embodiment of the disclosure.
Figure 6:
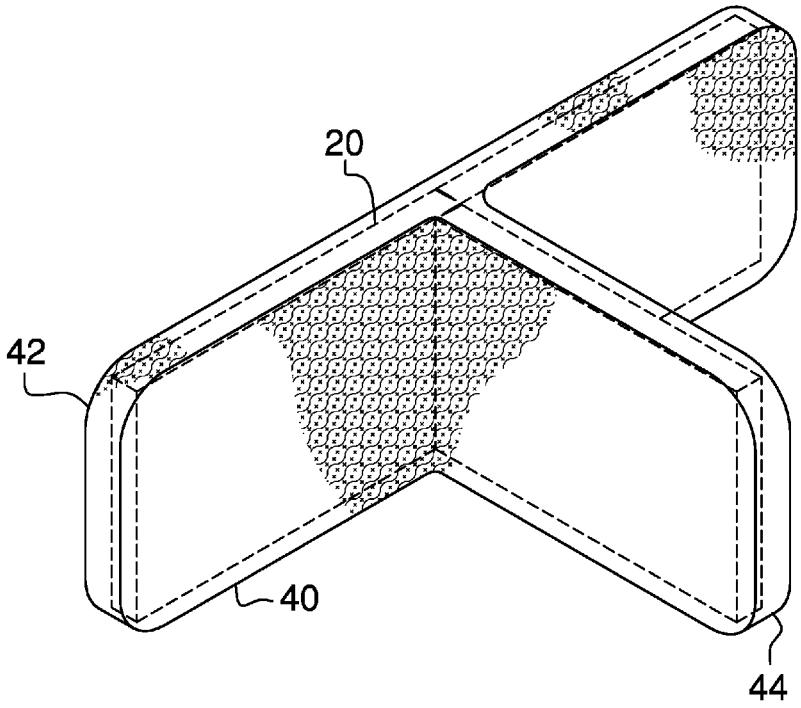
FIG. 6 is a perspective phantom view of a bag of an embodiment of the disclosure.

With reference now to the drawings, and in particular to FIGS. 1 through 6 thereof, a new barrier device embodying the principles and concepts of an embodiment of the disclosure and generally designated by the reference numeral 10 will be described.

As best illustrated in FIGS. 1 through 6, the sleep barrier system 10 generally comprises a bed 12 that has a top side 14, a headboard 16 and a pair of pillows 18. The bed 12 may be a sleeping bed 12 of any conventional design. A barrier 20 is provided and the barrier 20 is selectively positioned on the bed 12. The barrier 20 extends between the pair of pillows 18. Thus, the barrier 20 sequesters a pair of users 22 thereby inhibiting the users 22 from physically disturbing each other during sleep.

The barrier 20 comprises a first panel 24 that has a first surface 26 and a second surface 28. The first panel 24 has a first slit 30 extending through the second surface 28 toward the first surface 26. Thus, the first panel 24 is foldable along the first slit 30. The first slit 30 is centrally positioned and is vertically oriented on the first panel 24.

The first panel 24 is positioned to extend substantially along a width of the bed 12. Moreover, the first panel 24 is positioned between the headboard 16 and each of the pillows 18. The first panel 24 is comprised of a resiliently deformable material. The resiliently deformable material may be foam rubber or the like.

A second panel 32 is provided. The second panel 32 has a first end 34 and a primary surface 36. The first end 34 is coupled to the first surface 26 of the first panel 24. The second panel 32 is oriented perpendicular to the first panel 24. Moreover, the second panel 32 is aligned with the first slit 30.

The second panel 32 has a second slit 38 extending through the primary surface 36. Thus, the second panel 32 is foldable along the second slit 38. The second slit 38 is aligned with the first end 34. The second panel 32 is positioned to extend between each of the pillows 18. The second panel 32 is comprised of a resiliently deformable material.

A bag 40 is provided. The bag 40 has a first portion 42 that is oriented perpendicular to a second portion 44. The barrier 20 is positioned in the bag 40. The first panel 24 is positioned in the first portion 42 and the second panel 32 is positioned in the second portion 44.

In use, the barrier 20 is positioned in the bag 40 and the barrier 20 is positioned on the bed 12. The first panel 24 is oriented to extend between the headboard 16 and the pillows 18. The second panel 32 is oriented to extend forwardly between each of the pillows 18. Thus, the second panel 32 inhibits the users 22 from making physical contact during sleeping. The barrier 20 is selectively removed from the bed 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sleep barrier system comprising:

a bed having a top side, a headboard and a pair of pillows; and a barrier being selectively positioned on said bed, said barrier extending between said pair of pillows wherein said barrier is configured to sequester a pair of users thereby inhibiting the users from physically disturbing each other during sleep, wherein said barrier comprises a first panel having a first surface and a second surface, wherein said first panel is positioned to extend substantially along a width of said bed, said first panel being positioned between said headboard and each of said pillows, said first panel being comprised of a resiliently deformable material, said barrier comprising a second panel having a first end and a primary surface, said first end being coupled to said first surface such that said second panel is oriented perpendicular to said first panel, a top edge of said first panel being coplanar with an upper edge of said second panel, a bottom edge of said first panel being coplanar with a base edge of said second panel wherein said barrier is positionable in a stable position on said top side of said bed with said second panel extending perpendicularly with respect to both said top side of said bed and said headboard of said bed while said first panel extends perpendicularly up from said top side of said bed and parallel to said headboard wherein said barrier is positionable such that said second panel extends directly between said pair of pillows without said first panel being positioned between said pillows and said top side of said bed.

2. The system according to claim 1, wherein said first panel has a first slit extending through said second surface toward said first surface such that said first panel is foldable along said first slit, said first slit being centrally positioned and being vertically oriented on said first panel.

3. The system according to claim 2, wherein said second panel is aligned with said first slit.

4. The system according to claim 3, wherein said second panel has a second slit extending through said primary surface such that said second panel is foldable along said second slit, said second slit being aligned with said first end.

5. The system according to claim 4, further comprising said second panel being comprised of a resiliently deformable material.

6. The system according to claim 1, further comprising:

a bag having a first portion being oriented perpendicular to a second portion, said barrier being positioned in said bag having said first panel being positioned in said first portion and having said second panel being positioned in said second portion.

7. A sleep barrier system comprising:

a bed having a top side, a headboard and a pair of pillows; and a barrier being selectively positioned on said bed, said barrier extending between said pair of pillows wherein said barrier is configured to sequester a pair of users thereby inhibiting the users from physically disturbing each other during sleep, said barrier comprising:

a first panel having a first surface and a second surface, said first panel having a first slit extending through said second surface toward said first surface such that said first panel is foldable along said first slit, said first slit being centrally positioned and being vertically oriented on said first panel, said first panel being positioned to extend substantially along a width of said bed, said first panel being positioned between said headboard and each of said pillows, said first panel being comprised of a resiliently deformable material, a second panel having a first end and a primary surface, said first end being coupled to said first surface such that said second panel is oriented perpendicular to said first panel, said second panel being aligned with said first slit, said second panel having a second slit extending through said primary surface such that said second panel is foldable along said second slit, said second slit being aligned with said first end, a top edge of said first panel being coplanar with an upper edge of said second panel, a bottom edge of said first panel being coplanar with a base edge of said second panel wherein said barrier is positionable in a stable position on said top side of said bed with said second panel extending perpendicularly with respect to both said top side of said bed and said headboard of said bed while said first panel extends perpendicularly up from said top side of said bed and parallel to said headboard wherein said barrier is positionable such that said second panel extends directly between said pair of pillows without said first panel being positioned between said pillows and said top side of said bed, said second panel being comprised of a resiliently deformable material, and a bag having a first portion being oriented perpendicular to a second portion, said barrier being positioned in said bag having said first panel being positioned in said first portion and having said second panel being positioned in said second portion.

* * * * *